US006595782B1

(12) United States Patent
Hsiao

(10) Patent No.: US 6,595,782 B1
(45) Date of Patent: Jul. 22, 2003

(54) ELECTRIC PLUG HAVING ADAPTIVELY ROTATABLE CONNECTION MEMBER HOUSING

(75) Inventor: Feng-Shen Hsiao, Taipei (TW)

(73) Assignee: Rite-Tech Industrial Co., Ltd., Taipei (TW)

( * ) Notice: Subject to any disclaimer, the term of this patent is extended or adjusted under 35 U.S.C. 154(b) by 0 days.

(21) Appl. No.: 10/191,558

(22) Filed: Jul. 10, 2002

(51) Int. Cl.[7] ..... H01R 39/00
(52) U.S. Cl. ..... 439/13; 439/23
(58) Field of Search ..... 439/13, 131, 171–174, 439/20–26

(56) References Cited

U.S. PATENT DOCUMENTS 3,321,728 A * 5/1967 Cocco et al. ..... 439/26
5,809,136 A * 9/1998 Turner ..... 379/438
5,846,090 A * 12/1998 Lu ..... 439/26
6,068,490 A * 5/2000 Salzberg ..... 439/25
6,089,921 A * 7/2000 Chou ..... 439/640

* cited by examiner

*Primary Examiner*—Lynn Feild
*Assistant Examiner*—Hae Moon Hyeon
(74) *Attorney, Agent, or Firm*—Rosenberg, Klein & Lee

(57) ABSTRACT

A rotatable plug has a mediate disk received in the housing and having at least two connecting blades securely connected thereto, a mediate connector placed on top of the mediate disk, and a top disk received in the housing and placed on top of the mediate connector. A mediate slip ring is mounted around a periphery of the mediate connector and having a first end electrically connected to the securing element. A top slip ring is mounted around a periphery of the top connector and having a first end electrically connected to the securing element. A first screw is provided to secure engagement among the top connector, the top disk, the mediate connector and the mediate disk inside the housing.

8 Claims, 5 Drawing Sheets

ELECTRIC PLUG HAVING ADAPTIVELY ROTATABLE CONNECTION MEMBER HOUSING

BACKGROUND OF THE INVENTION

1. Field of the Invention

The present invention relates to a rotatable plug, and more particularly to a rotatable plug having a housing, at least two connecting blades, at least two disks securely received in the housing, at least two slip rings each mounted on a corresponding one of the two disks and being rotatable relative to the corresponding disk and at least two securing elements each received in the housing to securely engage with a corresponding one of the two slip rings. After the two slip rings are securely connected to the securing elements and the two connecting blades are electrically connected to the two disks, the plug is able to be rotated regardless of the connection between the two connecting blades and a power socket which is firmly fixed at a location.

2. Description of Related Art

A conventional plug normally has at least two connecting blades received in a housing and at least two electrical wires each connecting to a corresponding one of the at least two connecting blades. The at least two electrical wires extend to an electrical device, such as a blender, a shaver or a vacuum cleaner. To those who often do housekeeping jobs, all of the foregoing electrical devices sometimes need to be moved around, especially the shaver and the vacuum cleaner. When the electrical equipment is connected to a wall outlet, the cable of the electrical equipment often becomes twisted. As we all know, when the cable is twisted the cable is easily broken or the wires inside the cable are easily damaged due to excessive extension from the twist.

To overcome the shortcomings, the present invention tends to provide an improved plug to mitigate and obviate the aforementioned problems.

SUMMARY OF THE INVENTION

The primary objective of the present invention is to provide an improved plug which is rotatable so that there is no twist no matter how the plug is operated.

In order to accomplish the foregoing objective, the rotatable plug has a housing, at least two connecting blades, at least two disks securely received in the housing, at least two slip rings each mounted on a corresponding one of the at least two disks and being rotatable relative to the corresponding disk and at least two spacers each received in the housing to securely engage with a corresponding one of the at least two slip rings. After the at least two slip rings are securely connected to the spacers and the at least two connecting blades are electrically connected to the at least two disks, the plug is able to be rotated regardless of the connection between the at least two connecting blades and a power socket which is firmly fixed at a location.

Other objects, advantages and novel features of the invention will become more apparent from the following detailed description when taken in conjunction with the accompanying drawings.

DETAILED DESCRIPTION OF THE PREFERRED EMBODIMENT

Figure 1:
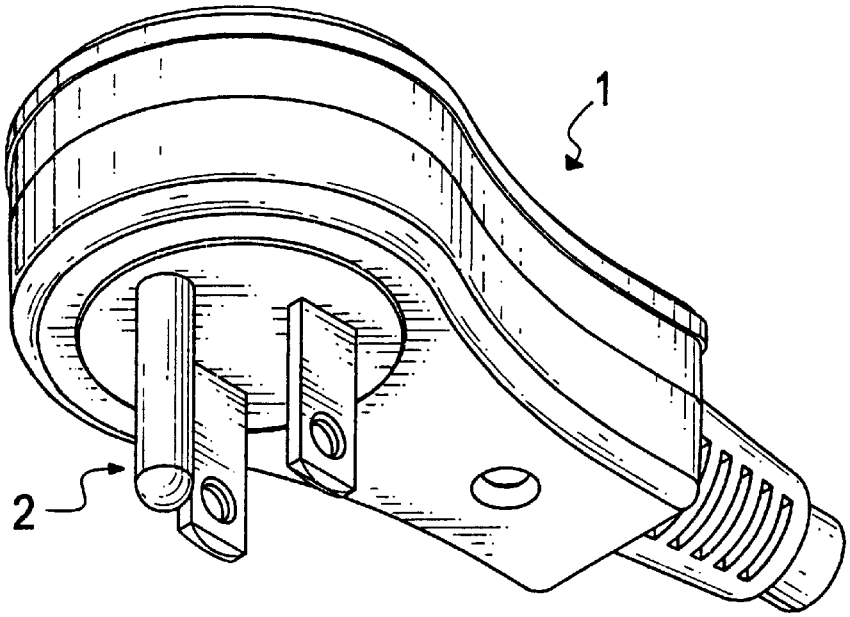
FIG. 1 is a perspective view of the plug of the present invention.
Figure 2:
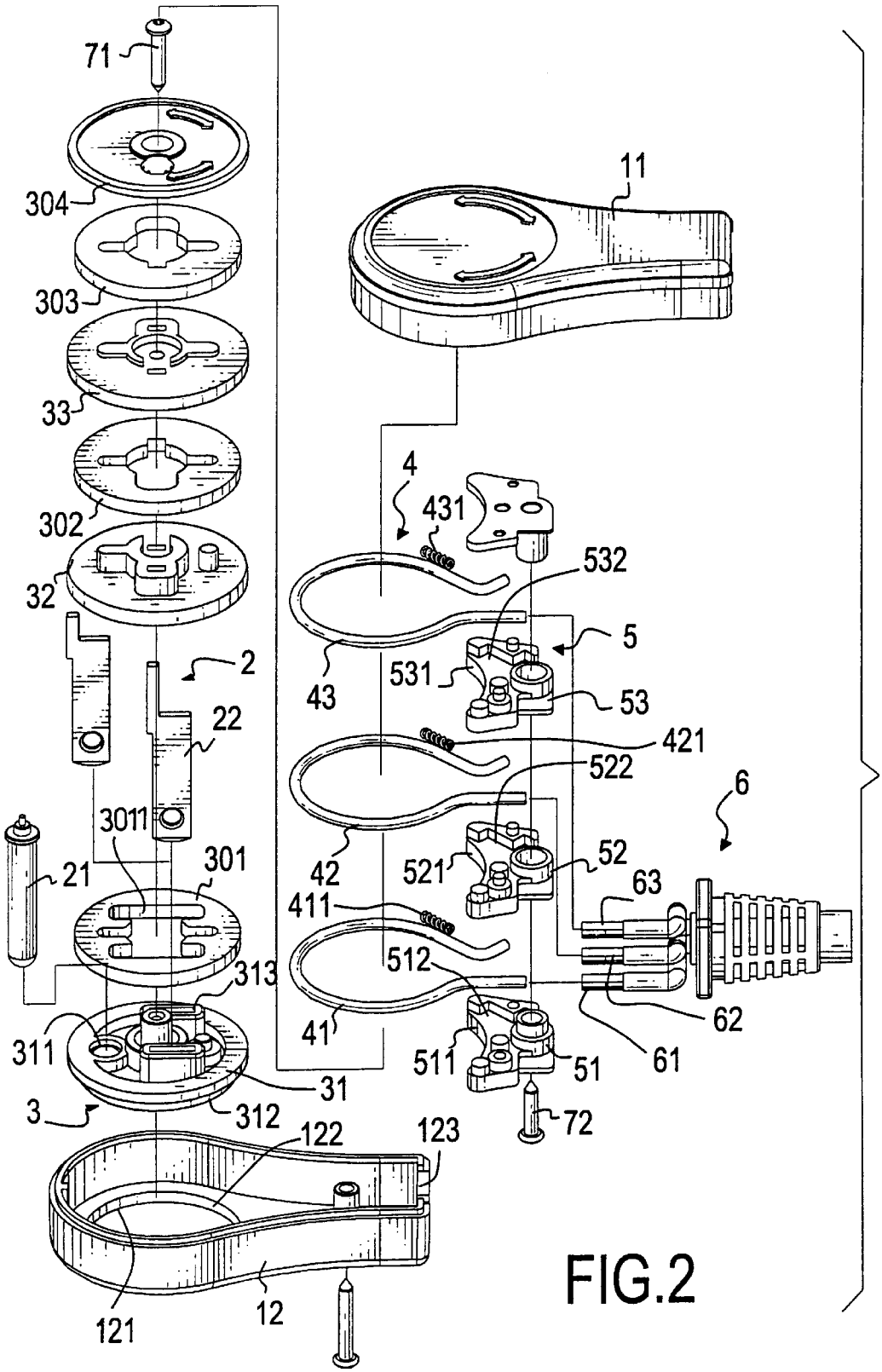
FIG. 2 is an exploded perspective view of the plug in FIG. 1.

With reference to FIGS. 1 and 2, the rotatable plug in accordance with the present invention has a housing (1) composed of a top cover (11) and a bottom cover (12), at least two connecting blades (2), at least two disks (3) securely received in the housing (1), at least two slip rings (4) each mounted on a corresponding one of the at least two disks (3) and each disk (3) being rotatable relative to the corresponding slip ring (4), at least two spacers (5) each engaged with a corresponding one of the at least two slip rings (4) so as to separate one slip ring (4) from the other(s) and a securing element (6) received in the housing (1) to securely engage with the at least two slip rings (4).

It is noted that there are three connecting blades (2), three disks (3), three slip rings (4) and three spacers (5) in this preferred embodiment.

The bottom cover (12) and the top cover (11) are hollow so that when the bottom and top cover (12,11) are assembled, the top and bottom cover (11,12) together define therebetween a space to receive therein the connecting blades (2), the disks (3), the slip rings (4), the spacers (5) and apart of the securing element (6). The bottom cover (12) has a through hole (121) defined in a front end of the bottom cover (12), a step (122) formed on an inner periphery defining the through hole (121) and a cutout (123) defined in a rear end of the bottom cover (12).

The three connecting blades (2) includes a ground blade (21) and two master blades (22), and the three disks (3) includes a bottom disk (31), a mediate disk (32) and atop disk (33) formed of non-conductive material. The bottom disk (31) has a bottom face so configured that when the bottom disk (31) is received in the bottom cover (12), the bottom disk (31) is supported by the step (122) and able to freely rotate on top of the throughhole (121). The bottom disk (31) further has a hole (311) defined through the bottom disk (31) to correspond to and support the ground blade (21), a bottom flange (312) formed to correspond to one of the three slip rings (4) and two slits (313) defined to correspond to the two master blades (22). A bottom connector (301) is provided on top of the bottom disk (31) and has channels (3011) defined to allow the extension of the two master blades (22). The two master blades (22) extend through the channels (3011) of the bottom connector (301) and arc supported by peripheries defining the channels (3011).

The mediate disk (32) is placed on top of the bottom connector (301). A mediate connector (302) is placed on top of the mediate disk (32). The top disk (33) is placed on top of the mediate connector (302) and a top connector (303) is placed on top of the top disk (33). A cap (304) is then placed on top of the top connector (303). A first screw (71) is provided to securely combine the cap (304), the top connector (303), the top disk (33), the mediate connector (302), the mediate disk (32), the bottom connector (301) and the bottom disk (31).

The three slip rings (4) include a bottom slip ring (41) corresponding to the bottom disk (31), a mediate slip ring (42) corresponding to the mediate disk (32) and a top slip ring (43) corresponding to the top disk (33). The three spacers (5) include a bottom spacer (51) corresponding to the bottom slip ring (41), a mediate spacer (52) corresponding to the mediate slip ring (42) and a top spacer (53) corresponding to the top slip ring (43).

When the foregoing elements are to be assembled, the bottom disk (31) is placed inside the bottom cover (12) with the ground blade (21) received in the hole (311) and extending out of the through hole (121) of the bottom cover (12). Then the bottom connector (30i) is placed on top of the bottom disk (31). The two master blades (22) extend through the channels (3011) of the bottom connector (301), the slits (313) of the bottom disk (31) and out of the through hole (12 1) of the bottom cover (12). Thereafter, the mediate disk (32), the mediate connector (302), the top disk (33), the top connector (303) and the cap (304) are sequentially placed on top of one another. The first screw (71) is applied to securely combine the foregoing elements inside the bottom cover (12).

The bottom spacer (51) has a first arcuate face (511) formed to correspond to and abut against a periphery of the bottom disk (31). The mediate spacer (52) has a second arcuate face (521) formed to correspond to and abut against a periphery of the mediate disk (32). The top spacer (53) has a third arcuate face (531) formed to correspond to and abut against a periphery of the top disk (33). Therefore, after the three disks (3) and the three connecting blades (2) are assembled in the bottom cover (12), the bottom spacer (51) is placed inside the bottom cover (12) with the first arcuate face (511) abutting the periphery of the bottom disk (31), the mediate spacer (52) is placed to have the second arcuate face (521) abutting the periphery of the mediate disk (32) and the top spacer (53) is placed to have the third arcuate face abutting the periphery of the top disk (33). A second screw (72) is applied to securely combine the bottom spacer (51), the mediate spacer (52) and the top spacer (53). Thereafter the bottom slip ring (41) is mounted around a periphery of the bottom connector (301) with a first end thereof extending out of the bottom spacer (51) and a second end thereof engaged with the bottom spacer (51). The mediate slip ring (42) is mounted around a periphery of the mediate connector (302) with a first end thereof extending out of the mediate spacer (52) and a second end thereof engaged with the mediate spacer (52). The top slip ring (43) is mounted around a periphery of the top disk (303) with a first end thereof extending out of the top spacer (53) and a second end thereof engaged with the top spacer (53).

Figure 3:
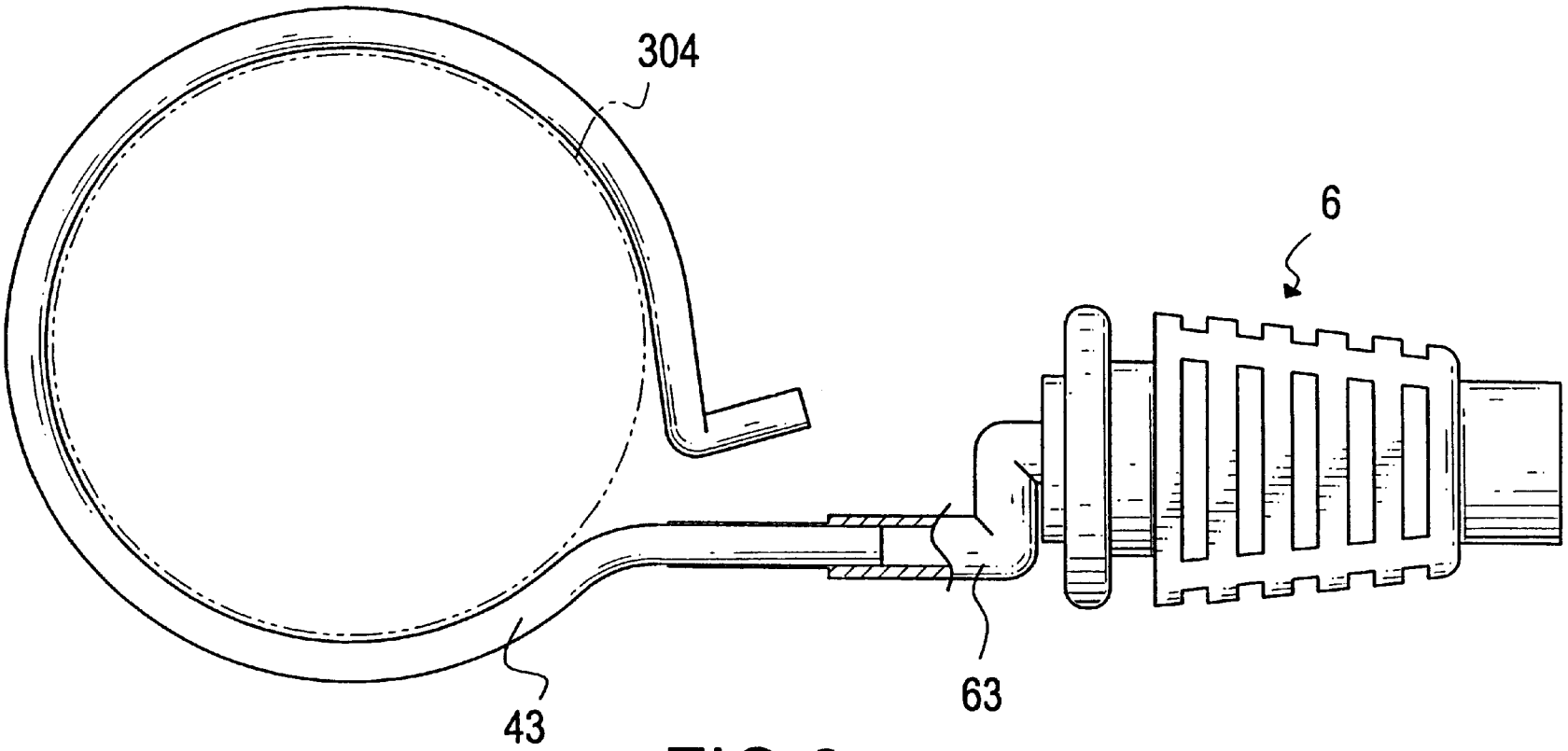
FIG. 3 is a schematic view showing the engagement of the slip ring and the securing element.
Figure 4:
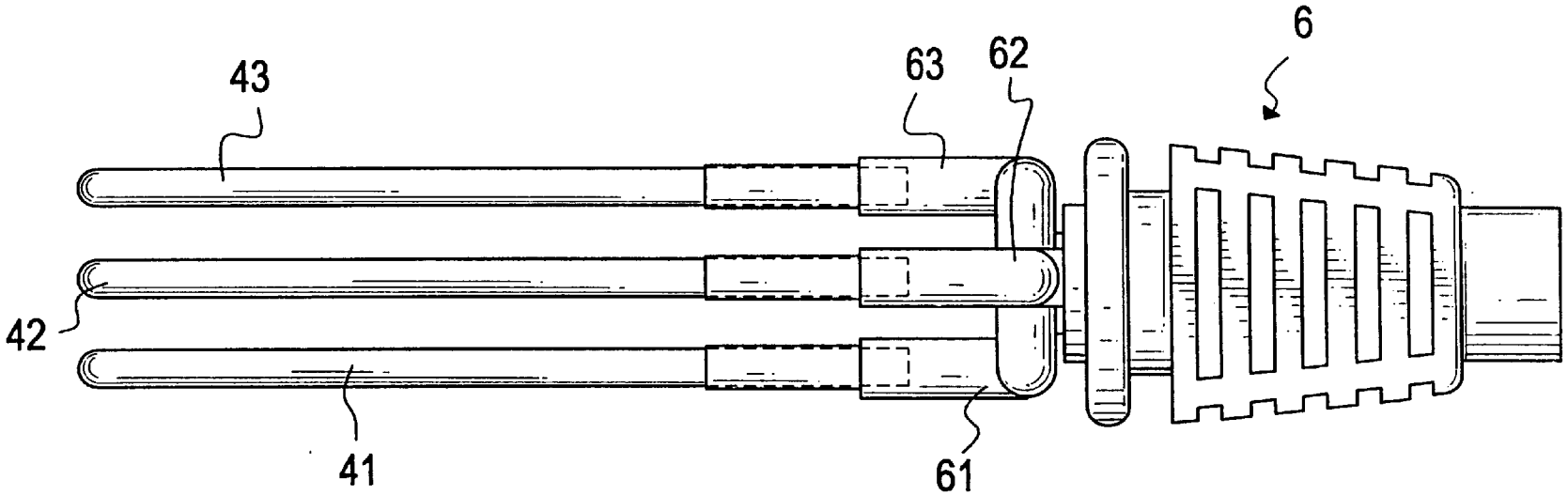
FIG. 4 is side plan view showing that three slip rings are engaged with the securing element.

With reference to FIGS. 3 and 4, after the first ends of the bottom, mediate and top slip rings (41,42,43) extend out of the bottom spacer (51), the mediate spacer (52) and the top spacer (53) respectively, the securing element (6) having three different connecting tubes (61,62,63) is applied to respectively receive the first ends of the bottom slip ring (41), the mediate slip ring (42) and the top slip ring (43).

Figure 5:
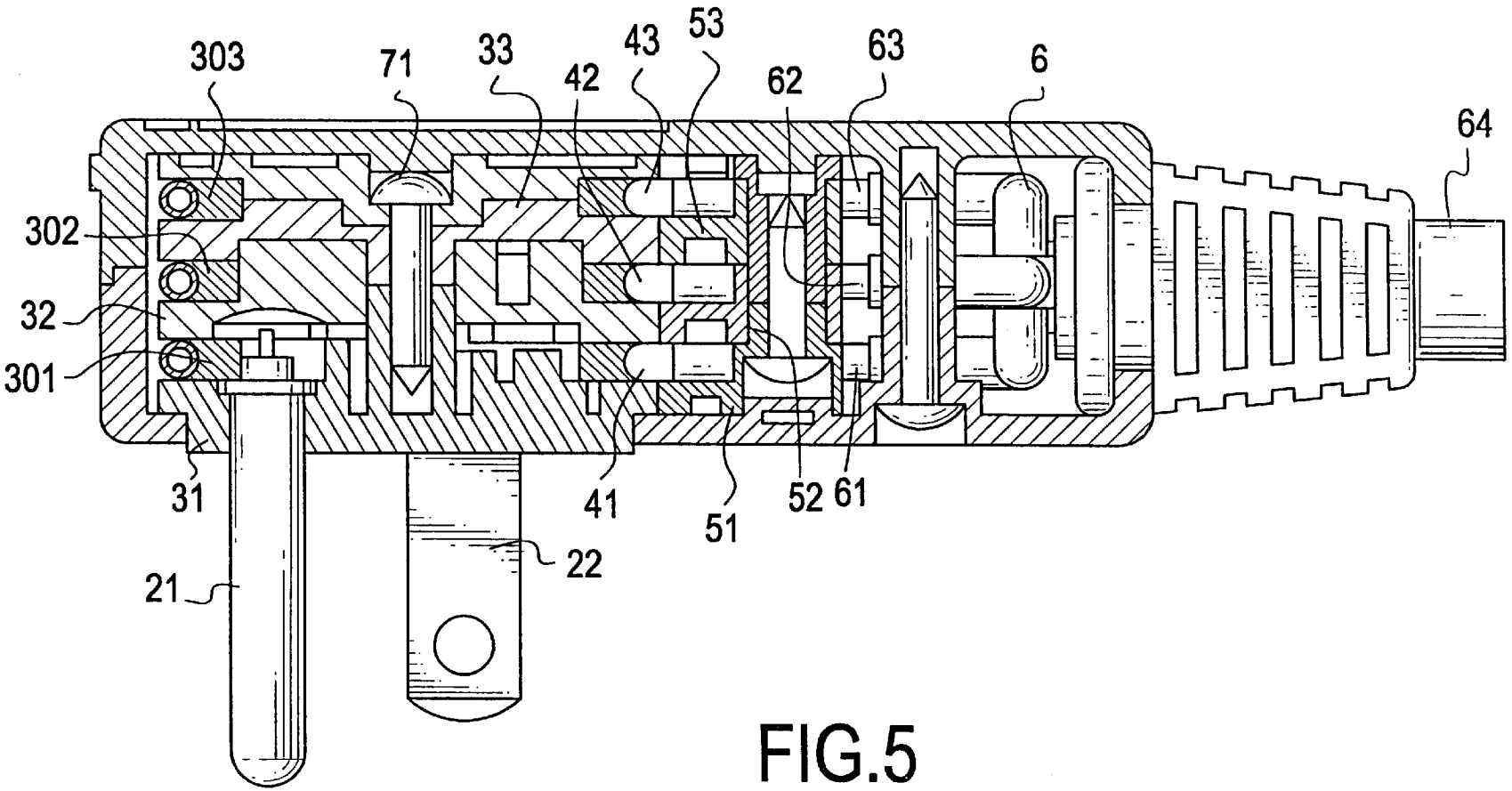
FIG. 5 is a schematic view showing the internal structure of the plug after assembly.

With reference to FIG. 5, it is noted that because the bottom disk (31) is supported by the periphery defining the through hole (121) of the bottom cover (12), the bottom disk (31) is rotatable relative to the bottom cover (12). Further, the bottom connector (301), the mediate disk (32), the mediate connector (302), the top disk (33) and the top connector (303) are securely connected with one another via the first screw (71) so that the combination of the bottom connector (301), the mediate disk (32), the mediate connector (302), the top disk (33) and the top connector (303) as well as the three connecting blades (2) are rotatable with respect to the bottom cover (12). Lastly, the top cover (11) is securely connected to the bottom cover (12) so as to enclose the combination of the bottom connector (301), the mediate disk (32), the mediate connector (302), the top disk (33) and the top connector (303) as well as the three connecting blades (2).

When the rotatable plug of the present invention is in application and the three connecting blades (2) are inserted into a socket or a wall outlet, the user is able to hold the securing element (6) and move around without twisting a cable (64) connecting directly to the securing element (6). As described earlier, the bottom slip ring (41), the mediate slip ring (42) and the top slip ring (43) are connected to the securing element (6). The bottom spacer (51), the mediate spacer (52) and the top spacer (53) are then respectively connected to the bottom slip ring (41), the mediate slip ring (42) and the top slip ring (43) such that the cable (64) can always have electrical connection with the three connecting blades (2).

Referring to FIG. 2, it is noted that the bottom spacer (51) has a first recess (512), the mediate spacer (52) has a second recess (522) aid the top spacer (53) has a third recess (532) for respectively receiving therein a first spring (411), a second spring (421) and a third spring (431). When second ends of the bottom slip ring (41), the mediate slip ring (42) and the top slip ring (43) respectively extend over the bottom, the mediate and top spacer (51, 52, 53), the first, the second and the third springs (411, 421, 431) respectively abut an outer periphery of the bottom slip ring (41), the mediate slip ring (42) and the top slip ring (43). This maintains the diameters of the bottom slip ring (41), the mediate slip ring (42) and the top slip ring (43) to enable secure electrically conductive engagement of the bottom slip ring (41), the mediate slip ring (42) and the top slip ring (43) with the bottom, the mediate and the top connectors (301, 302, 303).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A rotatable plug comprising:

a hollow housing provided with a through hole defined in a longitudinally extended bottom face thereof, the housing having a securing element extending longitudinally therefrom;

at least two connecting blades extending out of the housing transversely relative to the bottom face to be engageable with a power source;

a first disk received in the housing and retentively engaging portions of the at least two connecting blades;

a first connector placed on top of the first disk and electrically coupled to a first of the connecting blades;

a second disk received in the housing and placed on top of the first connector;

a second connector disposed on top of the second disk and electrically coupled to a second of the connecting blades;

a first slip ring mounted around a periphery of the first connector and having a terminal end electrically connected to the securing element;

a second slip ring mounted around a periphery of the second connector and having a terminal end electrically connected to the securing element; and a fastener securing together the first and second connectors and the first and second disks within the housing, the first disk being rotatable with respect to the housing about an axis directed transversely relative to the bottom face, power from a power source being transmitted from the at least two connecting blades to the first slip ring and the second slip ring, and thereby to the securing element.

2. In a rotatable plug having a hollow housing provided with a through hole defined in a bottom face of the housing, at least two connecting blades extending out of the housing to be engageable with a power source and a securing clement extending out of the housing electrically connected to the at least two connecting blades, wherein the improvements comprise:

a first disk received in the housing and retentively engaging portions of the at least two connecting blades;

a first connector disposed on top of the first disk and electrically coupled to a first of the connecting blades;

a second disk received in the housing and placed on top of the first connector;

a second connector disposed on top of the second disk and electrically coupled to a second of the connecting blades;

a first slip ring coupled to extend about a periphery of the first connector and having a terminal end electrically connected to the securing element;

a second slip ring coupled to extend about a periphery of the second connector and having a terminal end electrically connected to the securing element;

a fastener securing together the first and second connectors and the first and second disks within the housing, whereby the first disk is rotatable with respect to the housing, and power from a power source applied to the at least two connecting blades is transmitted to the first and second slip rings, and thereby to the securing element;

a third disk having a flange supported by a periphery of the housing defining the through hole thereof, the third disk having formed therein a hole and two slits, the slits respectively receiving the at least two connecting blades therethrough; and a ground connecting blade engaging the hole formed in the third disk and extending through the housing to be engageable with the power source.

3. The rotatable plug as claimed in claim 2 further comprising:

a third connector placed on top of the third disk and sandwiched between the third disk and the first disk; and a third slip ring mounted around a periphery of the third connector and having a terminal end electrically connected to the securing element.

4. The rotatable plug as claimed in claim 2 further comprising:

a first spacer having a first arcuate face to abut a periphery of the first disk; and a second spacer having a second arcuate face to abut a periphery of the second disk, wherein the first slip ring has an end engaged with the first spacer and the second slip ring has an end engaged with the second spacer.

5. The rotatable plug as claimed in claim 3 further comprising at least one spacer having an arcuate face to abut a periphery of at least one of the first, second and third disks, wherein the one of the first, second and third slip rings has an end securely engaged with the at least one spacer.

6. The rotatable plug as claimed in claim 4 further comprising a third spacer having a third arcuate face to abut a periphery of the third disk disposed beneath the first disk, a third connector disposed on top of the third disk, and a third slip ring having an end securely engaged with the third spacer.

7. In a rotatable plug having a hollow housing provided with a through hole defined in a bottom face of the housing, at least two connecting blades extending out of the housing to be engageable with a power source and a securing clement extending out of the housing electrically connected to the at least two connecting blades, wherein the improvements comprise:

a first disk received in the housing and retentively engaging portions of the at least two connecting blades;

a first connector disposed on top of the first disk and electrically coupled to a first of the connecting blades;

a second disk received in the housing and placed on top of the first connector;

a second connector disposed on top of the second disk and electrically coupled to a second of the connecting blades;

a first slip ring coupled to extend about a periphery of the first connector and having a terminal end electrically connected to the securing element;

a second slip ring coupled to extend about a periphery of the second connector and having a terminal end electrically connected to the securing element;

a fastener securing together the first and second connectors and the first and second disks within the housing, whereby the first disk is rotatable with respect to the housing, and power from a power source applied to the at least two connecting blades is transmitted to the first and second slip rings and thereby to the securing element;

a first spacer having a first arcuate face to abut a periphery of the first disk; and a second spacer having a second arcuate face to abut a periphery of the second disk, wherein the first slip ring has an end engaged with the first spacer and the second slip ring has an end engaged with the second spacer.

8. The rotatable plug as claimed in claim 7 further comprising a third spacer having a third arcuate face to abut a periphery of a third disk disposed beneath the first disk, a third connector disposed on top of the third disk, and a third slip ring having an end securely engaged with the third spacer.

* * * * *